US007617753B2

(12) United States Patent
Bouton et al.

(10) Patent No.: US 7,617,753 B2
(45) Date of Patent: Nov. 17, 2009

(54) HOT DOG CUTTING DEVICE

(76) Inventors: Todd R. Bouton, 3824 Braemore Dr., Janesville, WI (US) 53548; Angela K. Bouton, 3824 Braemore Dr., Janesville, WI (US) 53548

( * ) Notice: Subject to any disclaimer, the term of this patent is extended or adjusted under 35 U.S.C. 154(b) by 201 days.

(21) Appl. No.: 11/709,356

(22) Filed: Feb. 22, 2007

(65) Prior Publication Data

US 2008/0201956 A1 Aug. 28, 2008

(51) Int. Cl.
*B26D 7/01* (2006.01)
*B26D 7/06* (2006.01)

(52) U.S. Cl. ..... 83/167; 99/537; 83/932

(58) Field of Classification Search ..... 83/167, 83/932; 30/114–117; 99/430, 439, 441, 99/509, 537

See application file for complete search history.

(56) References Cited

U.S. PATENT DOCUMENTS

| | | | | | |
|---|---|---|---|---|---|
| 2,073,257 | A | * | 3/1937 | Van Riper | 83/581.1 |
| 2,520,000 | A | | 8/1950 | Dettman | |
| 2,552,046 | A | | 5/1951 | Justice | |
| 2,592,657 | A | * | 4/1952 | Cierley | 83/543 |
| 2,675,580 | A | | 4/1954 | Pesce | |
| 2,836,212 | A | * | 5/1958 | Shaw | 83/620 |
| 3,095,603 | A | | 7/1963 | May | |
| 3,257,725 | A | | 6/1966 | Dignard | |
| 3,465,802 | A | | 9/1969 | Alea | |
| 3,999,293 | A | | 12/1976 | Zubrycki | |
| 4,055,892 | A | * | 11/1977 | Del Vecchio | 30/303 |
| 4,557,053 | A | * | 12/1985 | Hadley, Jr. | 30/279.2 |
| 4,559,856 | A | * | 12/1985 | Pettus | 83/431 |
| 4,580,343 | A | * | 4/1986 | Bell, Jr. | 30/114 |
| 4,599,928 | A | * | 7/1986 | Oker | 83/581.1 |
| 4,964,323 | A | * | 10/1990 | Fortney | 83/167 |
| 4,969,379 | A | * | 11/1990 | Taylor et al. | 83/167 |
| 4,976,029 | A | * | 12/1990 | Kennedy | 30/114 |
| D329,967 | S | * | 10/1992 | Kennedy | D7/693 |
| 5,499,578 | A | * | 3/1996 | Payne | 99/537 |
| 5,662,033 | A | * | 9/1997 | Yawman | 99/538 |
| 5,692,424 | A | * | 12/1997 | Wallace | 83/167 |
| 5,771,771 | A | * | 6/1998 | Gagliardi, Jr. | 83/882 |
| 5,907,989 | A | * | 6/1999 | Sie et al. | 83/762 |
| 5,976,585 | A | | 11/1999 | Gagliardi | |
| 6,187,361 | B1 | | 2/2001 | Fleetham | |
| 6,451,262 | B1 | * | 9/2002 | Chiodo | 422/99 |
| 7,065,880 | B2 | * | 6/2006 | Howman et al. | 30/114 |
| 7,249,550 | B1 | * | 7/2007 | Thune, Jr. | 83/599 |
| 7,340,835 | B2 | * | 3/2008 | Howman et al. | 30/114 |
| 7,421,786 | B2 | * | 9/2008 | Dorion et al. | 30/114 |
| 2002/0100173 | A1 | * | 8/2002 | Suer et al. | 30/114 |
| 2003/0079350 | A1 | * | 5/2003 | Howman et al. | 30/114 |

* cited by examiner

*Primary Examiner*—Boyer D. Ashley
*Assistant Examiner*—Sean Michalski

(57) ABSTRACT

Molded in at least five discrete parts. Each of which are adapted to engage together to safely long wedge cut, slice, and then 3d dice a sausage food product. In this device one handle acts as a guide with no cutting means for a sausage while it's inserted in a cutter housing.

The cutter housing and handle bar apparatus could be pushed down at this point to reveal individual through slices, down the sausage length.

The opposite end of a handle bar apparatus would have a cutting means for a sausage, than inserted into a cutter housing. At this point the respective cutter housing and respective handle bar apparatus could be lifted off a food ejector to reveal long end to end wedge cuts.

Both, the long end cut operation, and sliced cut operation together would create a diced food product.

3 Claims, 20 Drawing Sheets

HOT DOG CUTTING DEVICE

BRIEF SUMMARY AND OBJECT OF THE INVENTION

The invention seeks to realize among other things the following:

The object of the invention is to provide a novel cutting mechanism that combines long cut capabilities with short sliced cut capabilities to create diced or cubed sausage, and simply cutting a hotdog with less time and work.

A principle object of the present invention is to have several designs and sizes to accommodate several size sausages, and could even be used to slice and dice a large variety of different food products, like soft fruits and vegetables as well.

A further important object of the present invention is to provide a safe easy way for elder people to cut there own sausage product the way they like them cut for ease of eating.

Another major object of the invention is to provide a fast and safe way for the on the go mom and dad to slice or dice the hot dogs in small easy to swallow pieces for the younger kids.

Another principle object is to provide a quick and safe three step operation for slicing and dicing a sausage product with out using a much slower and more dangerous knife.

Yet another principle object is to provide a mechanism with a momentary containment chamber that holds the sometimes hot finished cut up sausage product until it's ready to be served on a plate.

Yet another object of the present invention is to provide a cutting device that's possibly made of plastic and easily unassembled for washing by hand in a kitchen sink, or in a dish washer.

Still another object of the present invention is to provide a device that will make foods prepared with sliced and diced up sausages less cumbersome and fun for everyone of all ages in the family to prepare.

It is a further object of the invention to provide a lever locking device that can only be released by either end of the handle bar apparatus midway through a cutter housing, to ensure the device can only be used safely and properly.

These and other objects and advantages of the invention will become more fully apparent from the description of the views and the detailed embodiments that follow, or may be learned by the practice of the invention.

A sausage food product and a handle bar apparatus also sharing the same view are both in line with a food product inlet, located at one end of the respective cutter housing.

Figure 13:
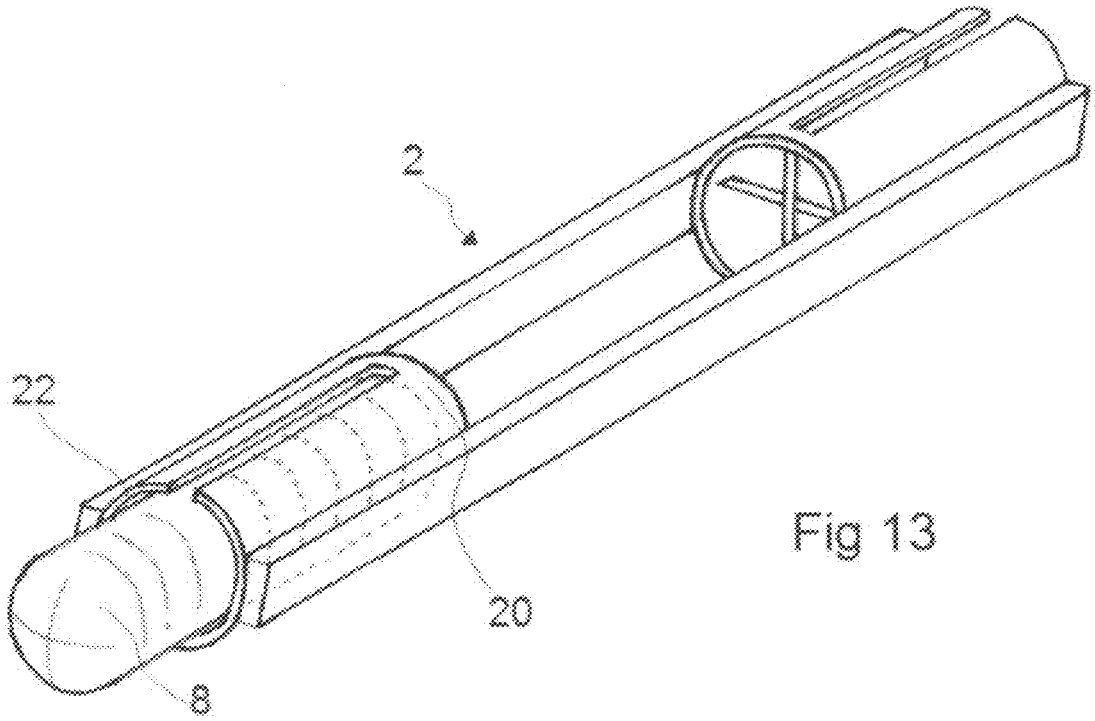

FIG. 13: Is a front, bottom, left side isometric view of a large sausage food product inside of a tubular containment chamber located at one end of a handle bar apparatus.

Figure 14:
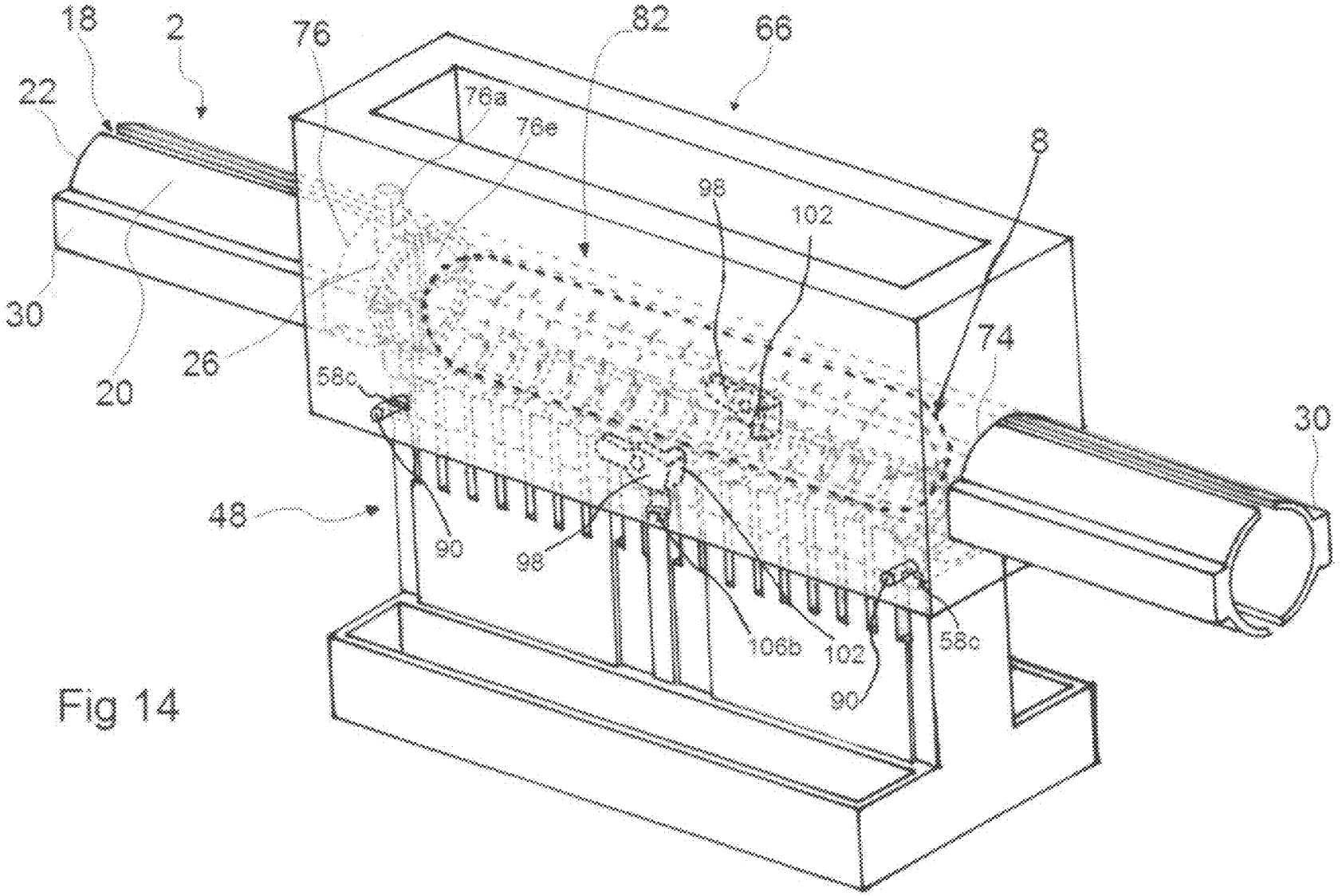

FIG. 14: Is a front, top, right side isometric view of a handle bar apparatus protruding out both sides of a cutter housing mounted over top of a food ejector forming a momentary food containment chamber together, with a large sausage food product shown in dark hidden lines. This view also shows the lever locks rotated away from there lock stop ledges located on the respective food ejector.

Figure 15:
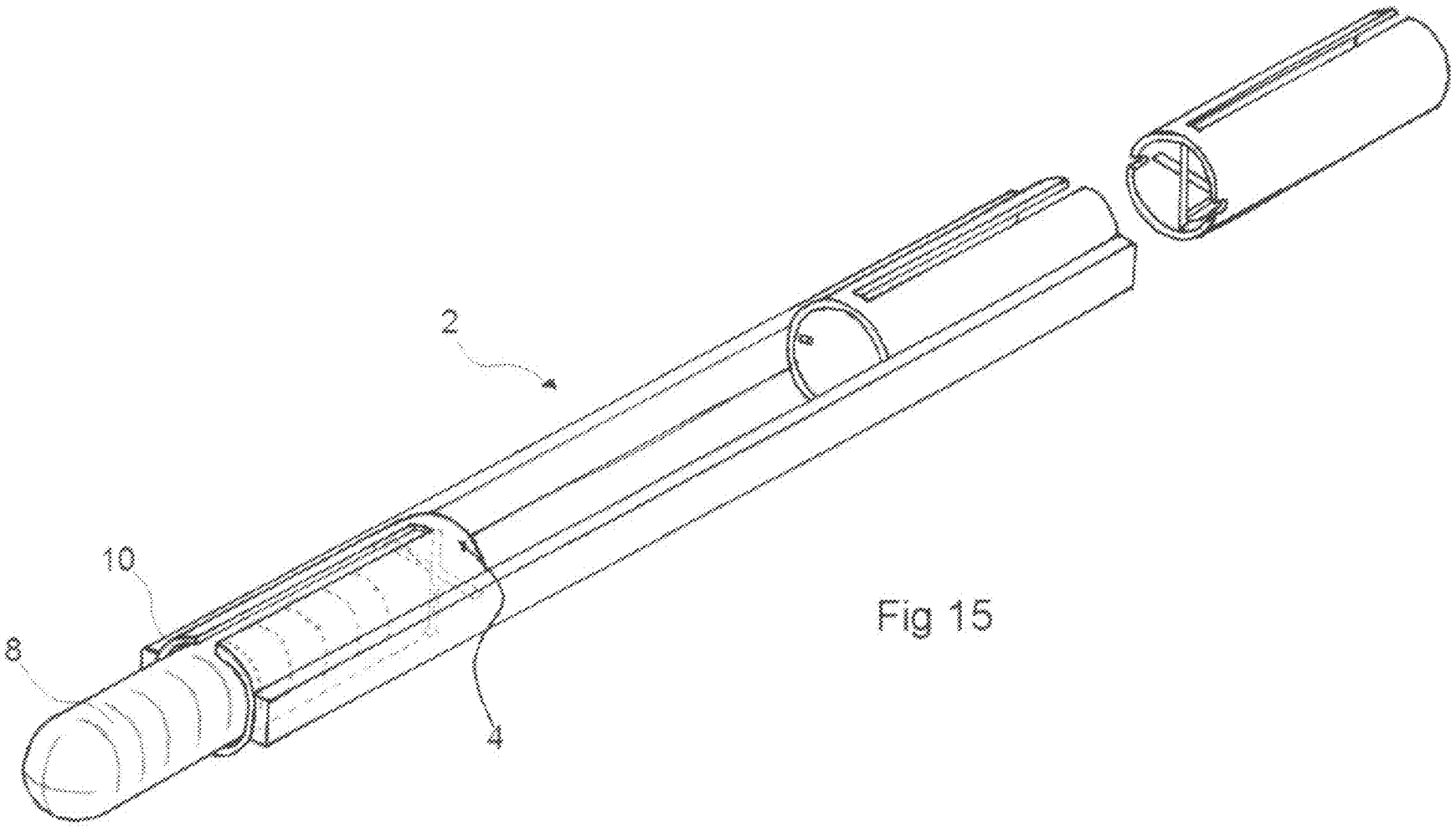

FIG. 15: Is a front, top, left side isometric view of a large sausage food product inside of a tubular containment cutting chamber located at one end of a handle bar apparatus, having a tubular sleeve containment cutting chamber shown at the opposite end.

Figure 16:
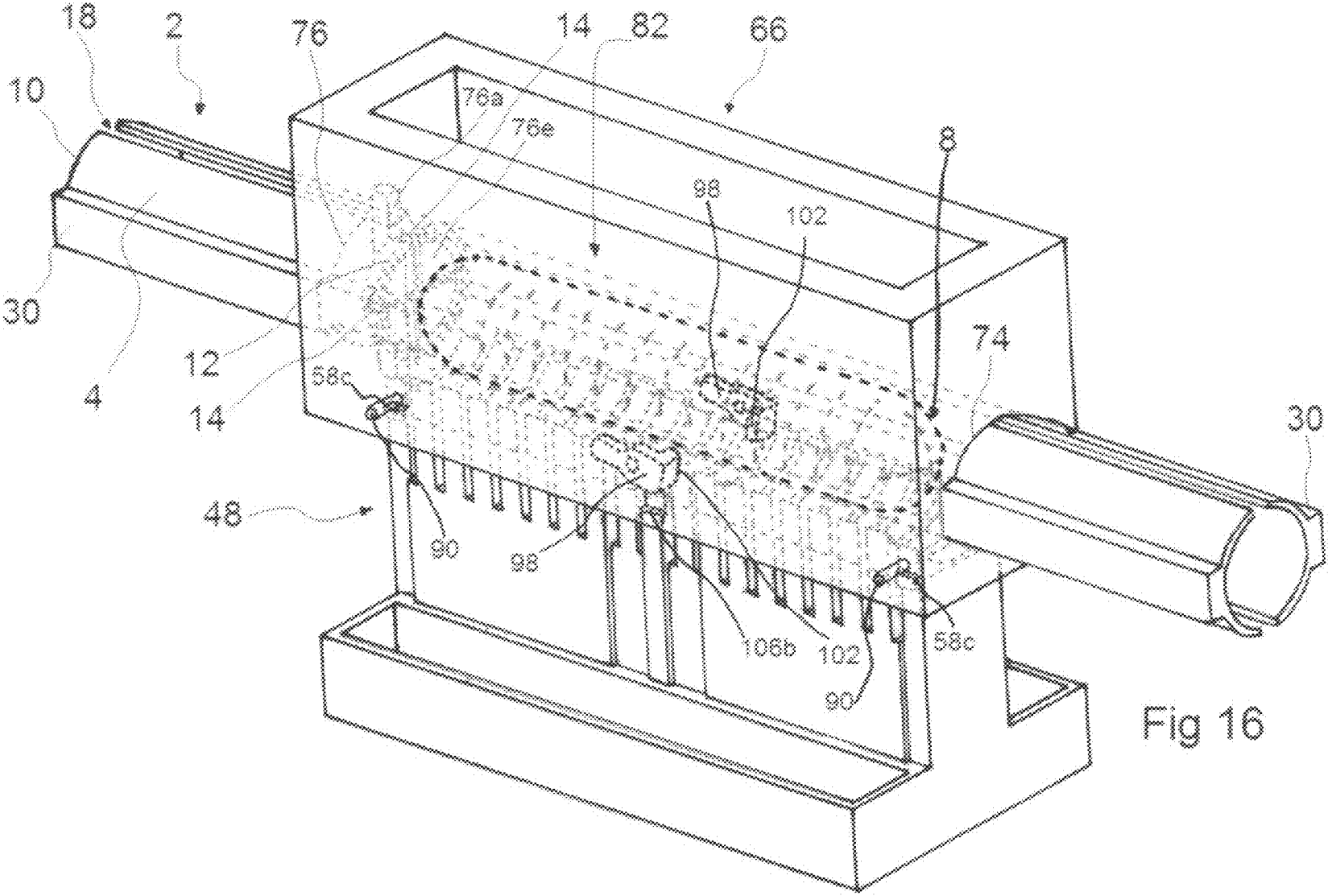

FIG. 16: Is a front, top, right side isometric view of a handle bar apparatus protruding out both sides of a cutter housing mounted over top of a food ejector forming a momentary food containment chamber together, with a large sausage food product shown in dark hidden lines. This view also shows the lever locks rotated away from there lock stop ledges located on the respective food ejector.

Figure 17:
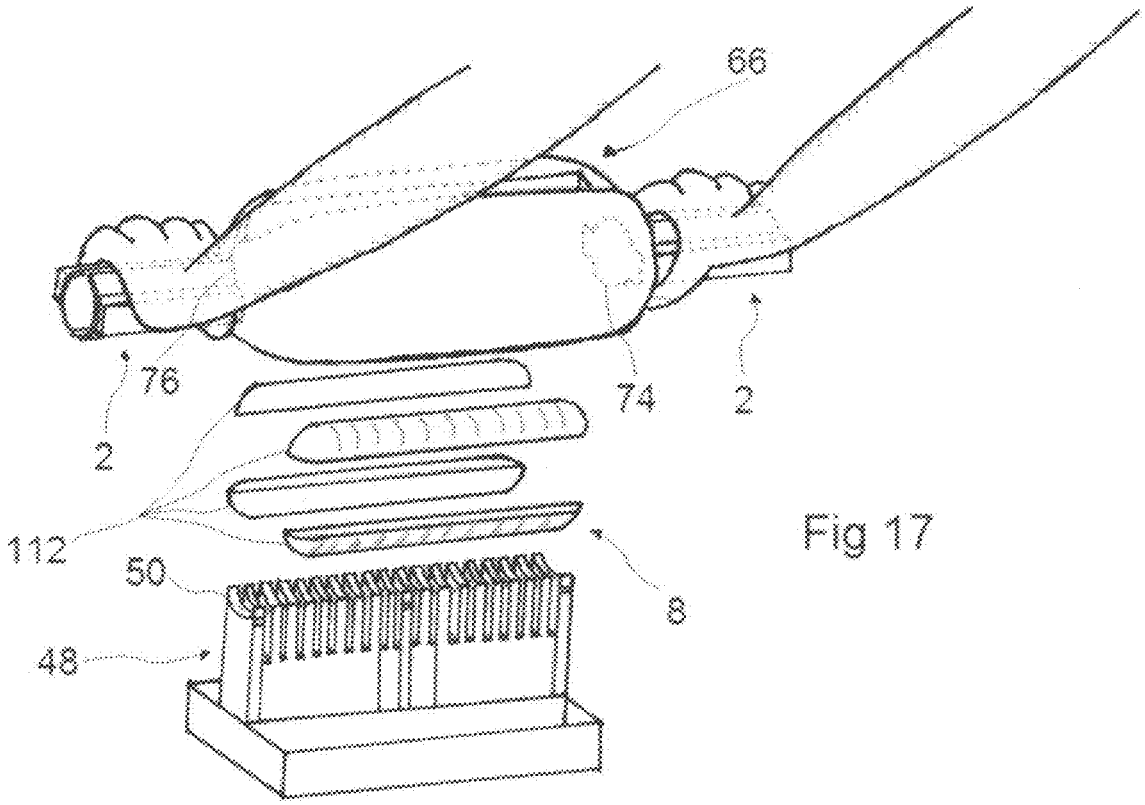

FIG. 17: Is a front, top, left side isometric view of a handle bar apparatus protruding out both sides of a cutter housing just above a food ejector. This view also shows the long wedge cuts made on a hot dog created from this device.

Figure 18:
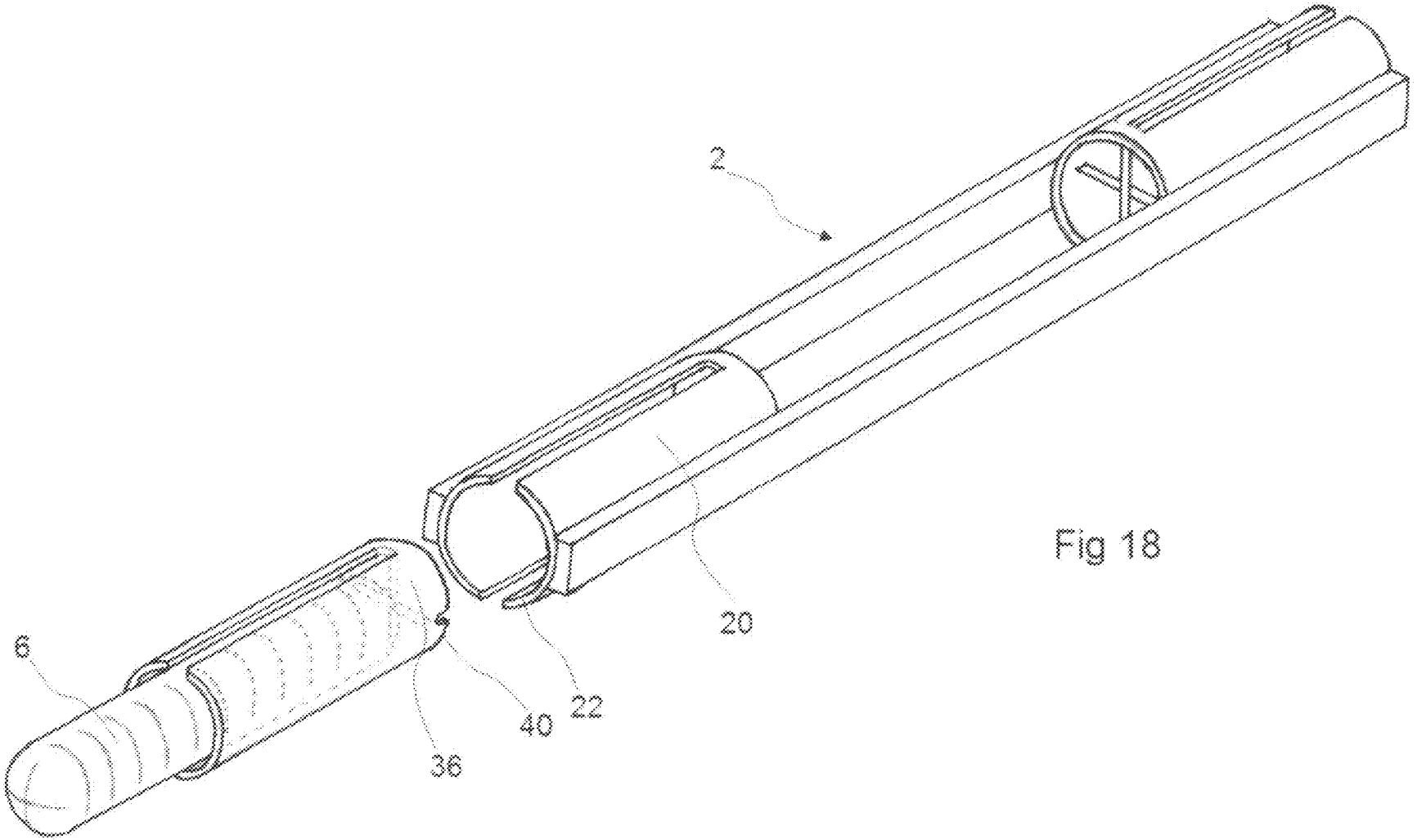

FIG. 18: Is a front, top, left side isometric view of a large sausage food product inside of a tubular sleeve containment cutting chamber shown at one end of a handle bar apparatus.

Figure 19:
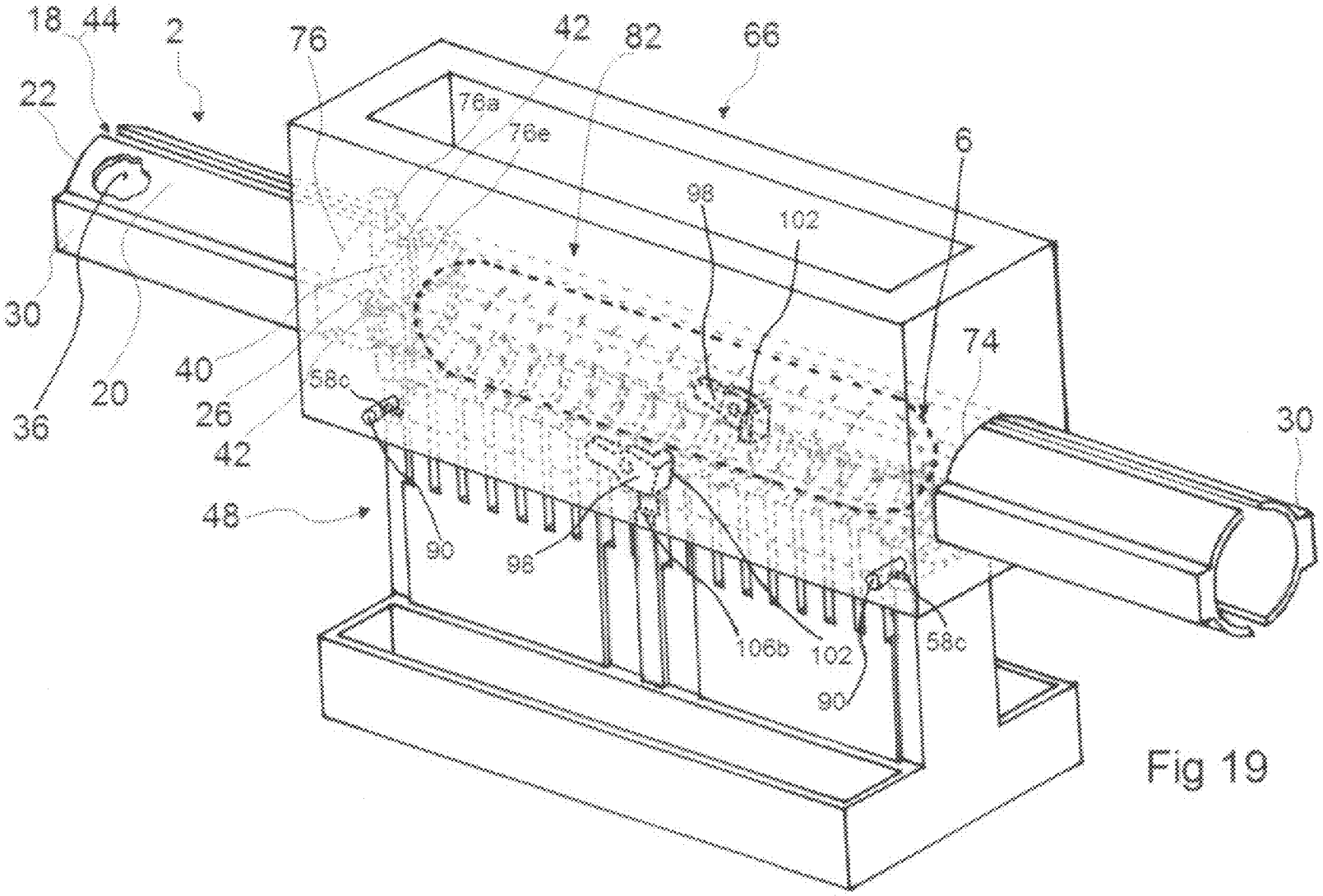

FIG. 19: Is a front, top, right side isometric view of a handle bar apparatus protruding out both sides of a cutter housing mounted over top of a food ejector forming a momentary food containment chamber together, with a large sausage food product shown in dark hidden lines.

This view also shows a (drawn cut out viewing window), through a tubular containment chamber to show a tubular sleeve containment cutting chamber telescopically mounted.

Figure 20:
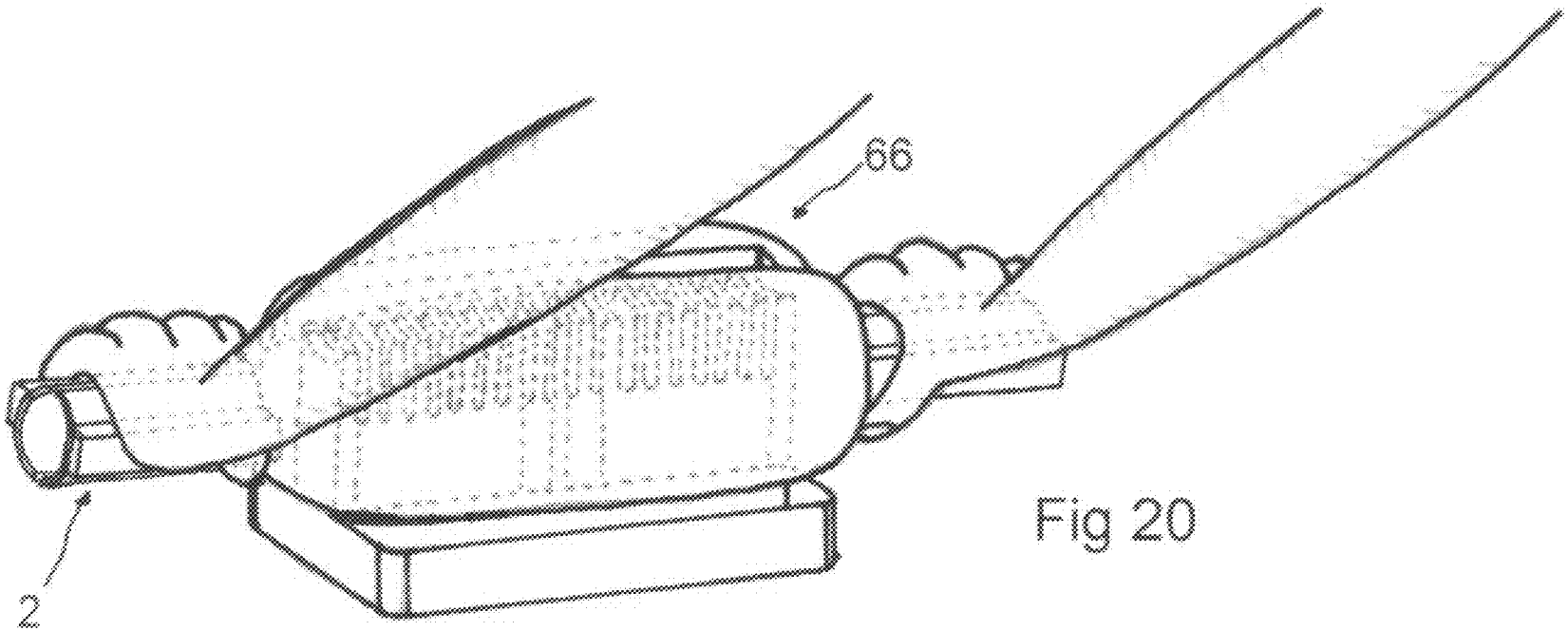

FIG. 20: Is a front, top, left side isometric view of a handle bar apparatus protruding out both sides of a cutter housing pushed all the way down over top of a food ejector.

FIELD AND BACKGROUND OF THE INVENTION

The present invention relates in general to a kitchen cutting device and in particular to a new and useful manual safer cutting device with a quick and easy way to slice, dice, and create long wedge cuts through an elongated hotdog and or a sausage food product known in the art as frankfurters or wieners. Prior art shows that inventions that cut a plurality of slices down the longitudinal length, by way of example, U.S. Pat. No. 5,499,578 and U.S. Pat. No. 5,456,010 require the handling and use of a knife to execute a cut.

When my invention cuts a plurality of slices down the longitudinal length of a sausage, it is equipped with an array of cutting blades completely enclosed inside of a cutter housing to avoid any kind of accidental cuts caused by the now unnecessary use of an exposed knife.

Prior art shows that inventions that cut long longitudinal wedge pieces, by way of example, U.S. Pat. No. 2,675,580 requires that a person have one hand on the sausage while simultaneously forcing the sausage through the cutter knives leaving the possibility of personal injury to there figures from this form of usage. My invention puts to use a handle bar apparatus, and a food barrier to execute a cut, while a person having one hand on the tubular containment chamber, forces the tubular containment cutting chamber past the respective food barrier while simultaneously cutting long longitudinal wedge pieces of a sausage from one end to the other.

Prior art also shows that inventions that create long longitudinal wedge cuts in the security of a cutting chamber by way of example, U.S. Pat. No. 5,771,771 do not allow long longitudinal cuts to sever all the way through with in the cutting chamber, leaving a diameter of at least one-quarter of an inch of longitudinal core down the center of the sausage.

Other prior art also shows that inventions that create diced cuts in the security of a cutting chamber by way of example, U.S. Pat. No. 7,065,880 does not show any obvious locking mechanism to prevent the execution of the cutting blades while the chamber is open.

In my invention, a person would have a choice of sliced, diced, or long longitudinal wedge severed through completely discrete pieces of sausage, and would ultimately offer kids, elderly, and people of all ages a better way to prevent choking or any kind of blocking of the air way, from a large sausage, or loosely connected pieces of hotdogs in a totally safe manner.

While these devices fulfill their respective, particular objectives and requirements for cutting a sausage food product. The aforementioned patents do not describe a sausage cutter for creating cubed or diced cut through pieces in a safe manner. Therefore the above mentioned patents do not fulfill the true objective of a totally safe means for cutting.

In both respects, the sausage cutter according to the present invention substantially departs from the conventional concepts and designs of the prior art, and in doing so provides an apparatus primarily developed for the purpose of finding a safer method for slicing, dicing, and creating long wedge cuts of a food product as I have done in my mockup.

DETAILED DESCRIPTION OF THE EMBODIMENT

Part number one: A handle bar apparatus. In the drawings, reference numeral 2 istermed and indicates a handle bar apparatus in accordance with the invention.

Figure 2:
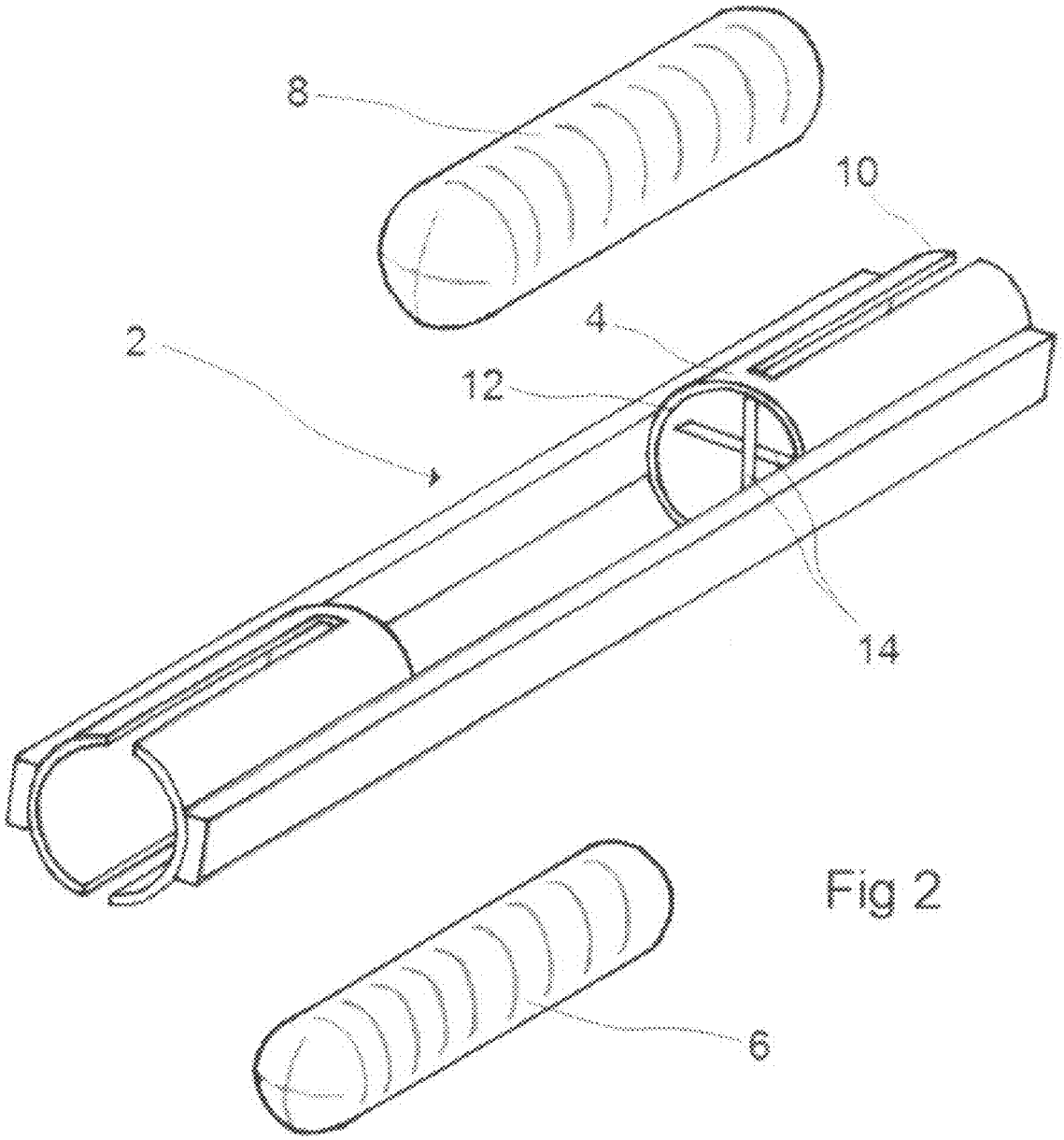
FIG. 2: Is a front, top, left side isometric view of a handle bar apparatus showing a large sausage food product up above, and a small sausage food product down below.

FIG. 2 A handle bar apparatus 2 for slicing a food product 6, 8 includes at one end a tubular containment cutting chamber 4.

A tubular containment cutting chamber 4 having a food product inlet 10 at one end and a food product outlet 12 which is provided with a set of perpendicular blades 14 for cutting.

Figure 3:
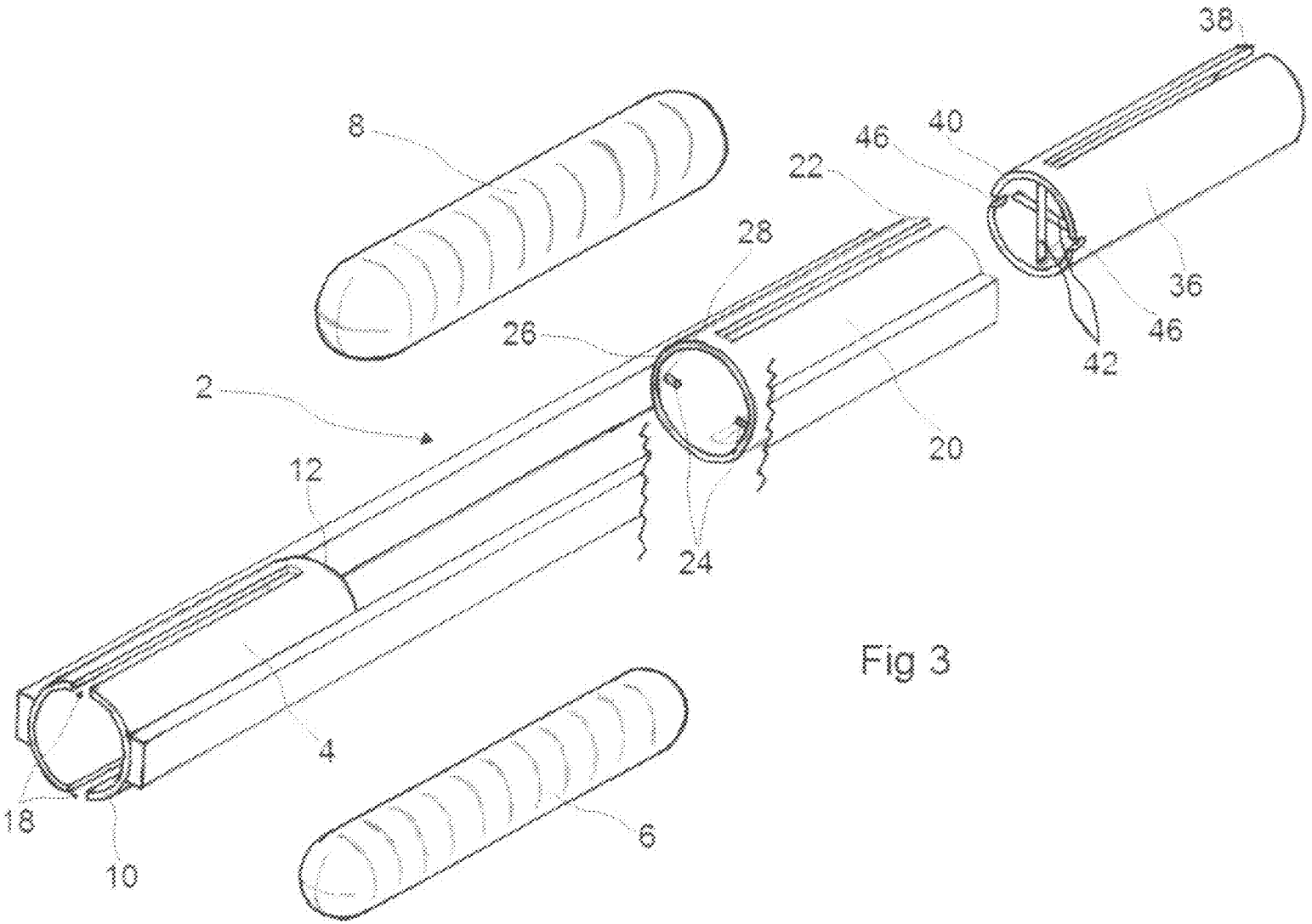
FIG. 3: Is a front, top, left side isometric view of a handle bar apparatus with a tubular sleeve containment cutting chamber at one end showing a large sausage food product up above, and a small sausage food product down below.

FIG. 3 A slot 18 having an opening from a food product inlet end 10, and extending the respective opening to a distance short of the food product outlet end 12, without an opening.

A handle bar apparatus 2 for slicing a food product 6, 8 includes at the opposite longitudinal end a tubular containment chamber 20

A tubular containment chamber 20 is provided with a food product inlet 22 at one end and a food product outlet 26 at the other end, having two locator pins 24.

A locator pin 24 having a fixed mount 28 on the inside circumference of tubular containment chambers 20 food product outlet end 26. (only one of two fixed mounts shown in FIG. 3)

Figure 4:
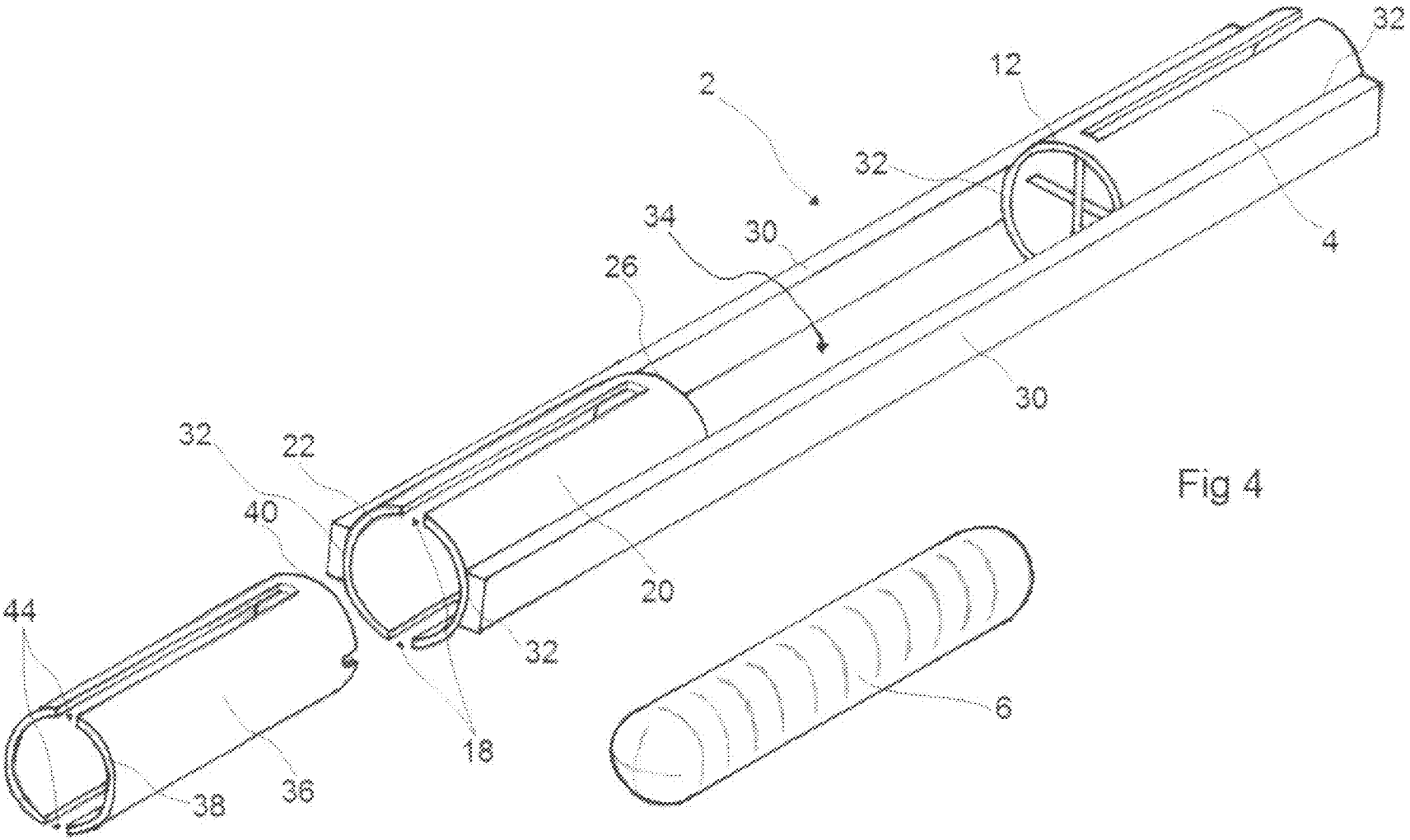
FIG. 4: Is a front, top, left side isometric view of a handle bar apparatus with a tubular sleeve containment cutting chamber at one end showing a small sausage food product down below.

FIG. 4 A slot 18 having an opening from a food product inlet end 22 and extending the respective opening to a distance short of the food product outlet end 26 without an opening.

A horizontal guide beam 30 having the same longitudinal axis as a tubular containment cutting chamber 4 and a tubular containment chamber 20.

A tubular containment cutting chamber 4 and the tubular containment chamber 20 have a fixed mount 32 on the outer surface with a guide beam 30.

A middle portion 34 of a guide beam 30 spanning an opening between the food product outlet end 12 of a tubular containment cutting chamber 4 and a food product outlet end 26 of a tubular containment chamber 20, combined to form a handle bar apparatus 2.

Part number two: A tubular sleeve containment cutting chamber.

FIG. 3 An internal tubular sleeve containment cutting chamber 36 is in the form of a smaller version of a tubular containment cutting chamber 4, and is configured to be telescopically joined into a tubular containment chamber 20.

An internal tubular sleeve containment cutting chamber 36 having a food product inlet 38 at one end, and a food product outlet 40, which is provided with a set of perpendicular blades 42 for cutting.

FIG. 4 A slot 44 having an opening from the food product inlet end 38 and extending the respective opening to a distance short of a food product outlet end 40 without an opening.

FIG. 3 An internal tubular sleeve containment cutting chamber 36 having a locator slot 46 with an opening at its food product outlet end 40.

A locator slot 46 is used for locating, and aligning the outside diameter of a internal tubular sleeve containment cutting chamber 36, with a locator pin 24 inside of a tubular containment chamber 20.

Part number three: A food ejector.

Figure 5:
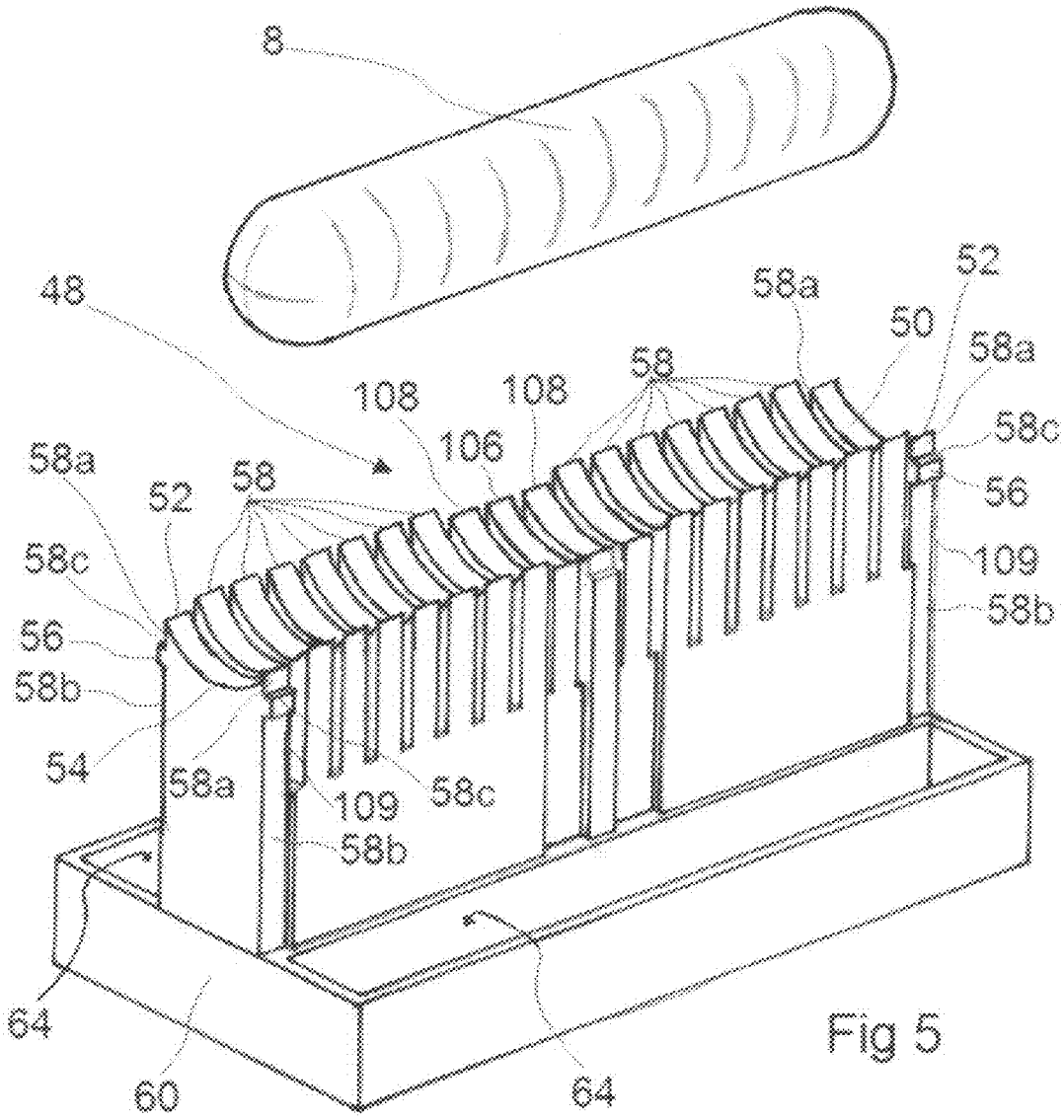
FIG. 5: Is a front, top, left side isometric view of a food ejector showing a large sausage food product up above.

FIG. 5 In the drawings, reference numeral 48 istermed and indicates a food ejector in accordance with the invention.

A food ejector having a plurality of pusher fingers 58, 106, 108, 109 extending upward.

A food ejector 48 is provided with a top surface 50.

Figure 10:
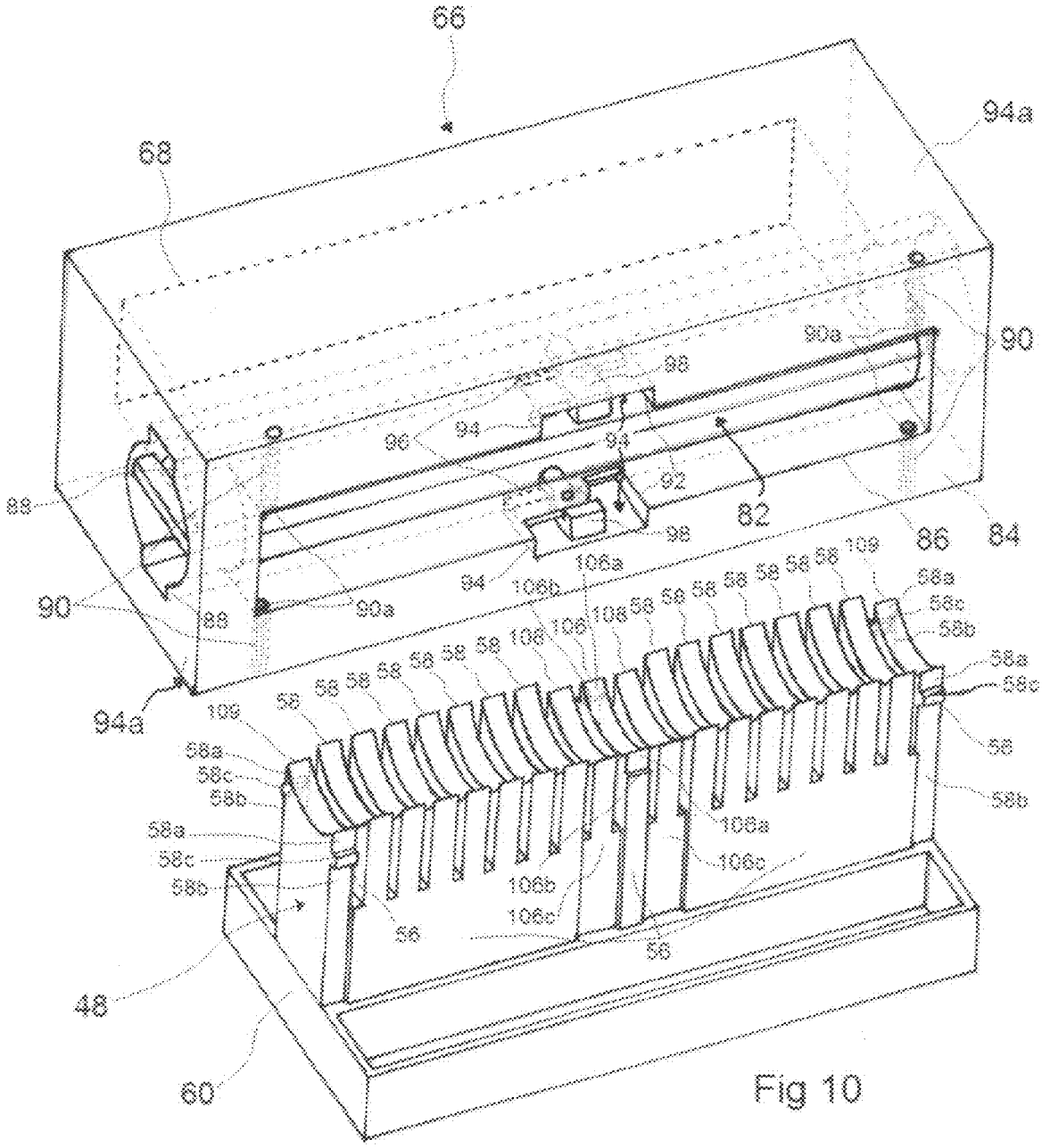
FIG. 10: Is a front, bottom, left side isometric view of a cutter housing above a front, top, left side isometric view of a food ejector.

FIG. 10 A food ejectors 48 top surface is configured smaller in length, and width to allow passage therethrough a cutter housings 66 food ejectors inlet 86 and a food product outlet 68.

FIG. 5 A food ejectors 48 top surface 50 is recessed, having the sides 52 higher than the center 54, on the respective top surface 50, creating a centering means for a food product 8.

A food ejector 48 having an array of transversely oriented clearance slots open from the top surface 50 and also opened on both side surfaces 56, extending downwardly to a predetermined clearance depth, forming pusher fingers 58, 106, 108, 109.

FIG. 10 An upper side depression 58*a* located on a pusher fingers 109 side surface 56, forming a spring plunger resting position 58*c* for a spring plunger 90.

A lower side depression 58*b* located on a pusher fingers 109 side surface 56, forming a lower clearance for a spring plunger 90.

FIG. 5 A top surface of a base 60 is fixed mounted to the bottom of a food ejectors 48 plunger fingers 58, 106, 108, 109.

A base extends out laterally from the food ejectors 48 plunger fingers 58, 106, 108, 109, for enhanced stability in the form of a reservoir 64.

Part number four: A cutter housing.

Figure 6:
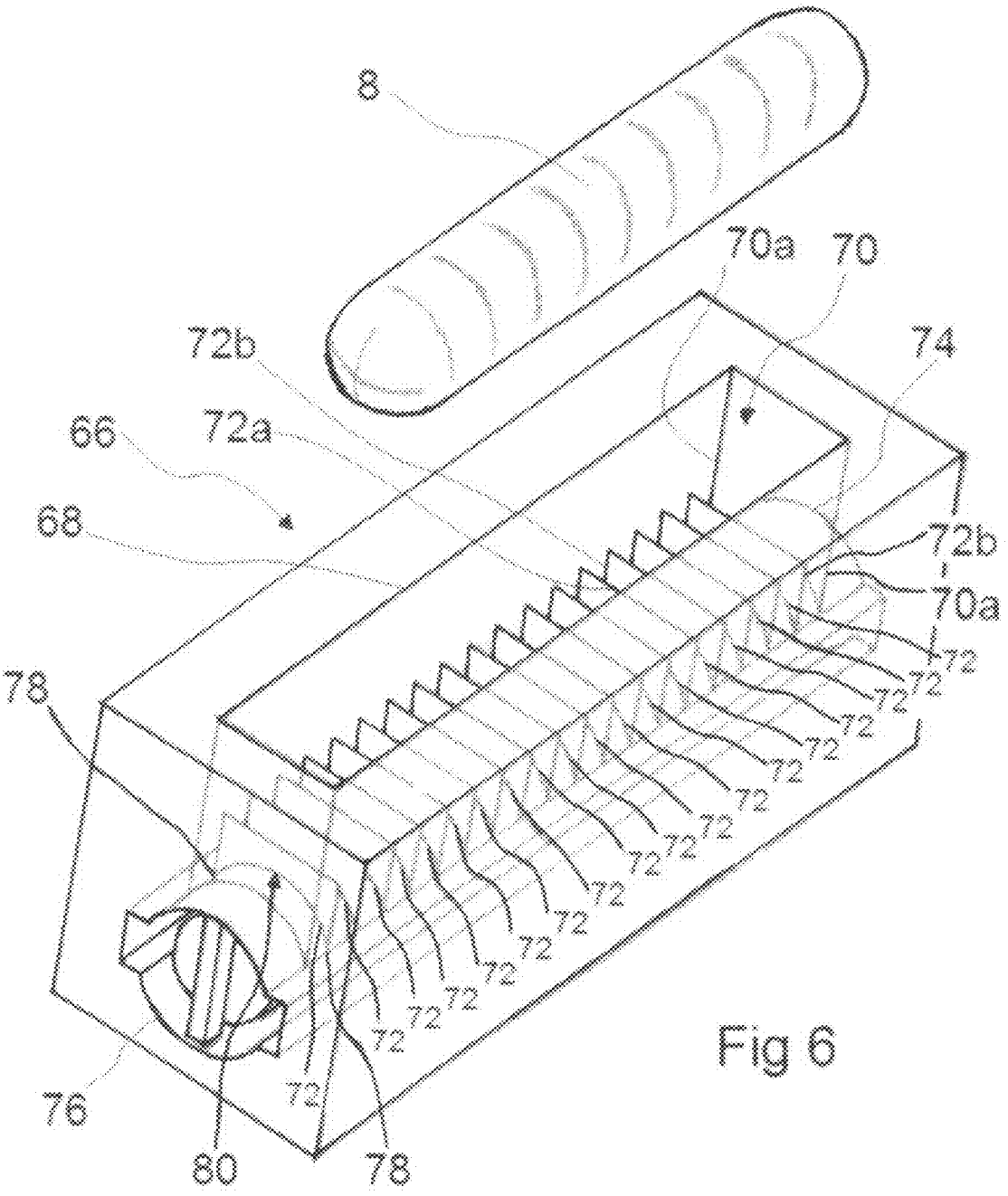
FIG. 6: Is a front, top and left side isometric view of a cutter housing showing a large sausage food product up above.

FIG. 6 In the drawings, reference numeral 66 istermed and indicates a cutter housing in accordance with the invention.

A cutter housing 66 is provided with an upper momentary food containment chamber 70 located on a top surface.

An upper momentary food containment chamber 70 is provided with an array of transversely oriented cutting blades 72 configured longitudinally.

A cutter blades 72 top surface 72*a* starts from the bottom of the upper momentary food containment chamber 70, and extends downwardly to the top circumference on a handle bar inlet 74, and handle bar outlet 76.

Each of the cutter blades 72 ends require a fixed mount 72*b* to an upper momentary food containment chambers 70 inside surface 70*a*.

Figure 7:
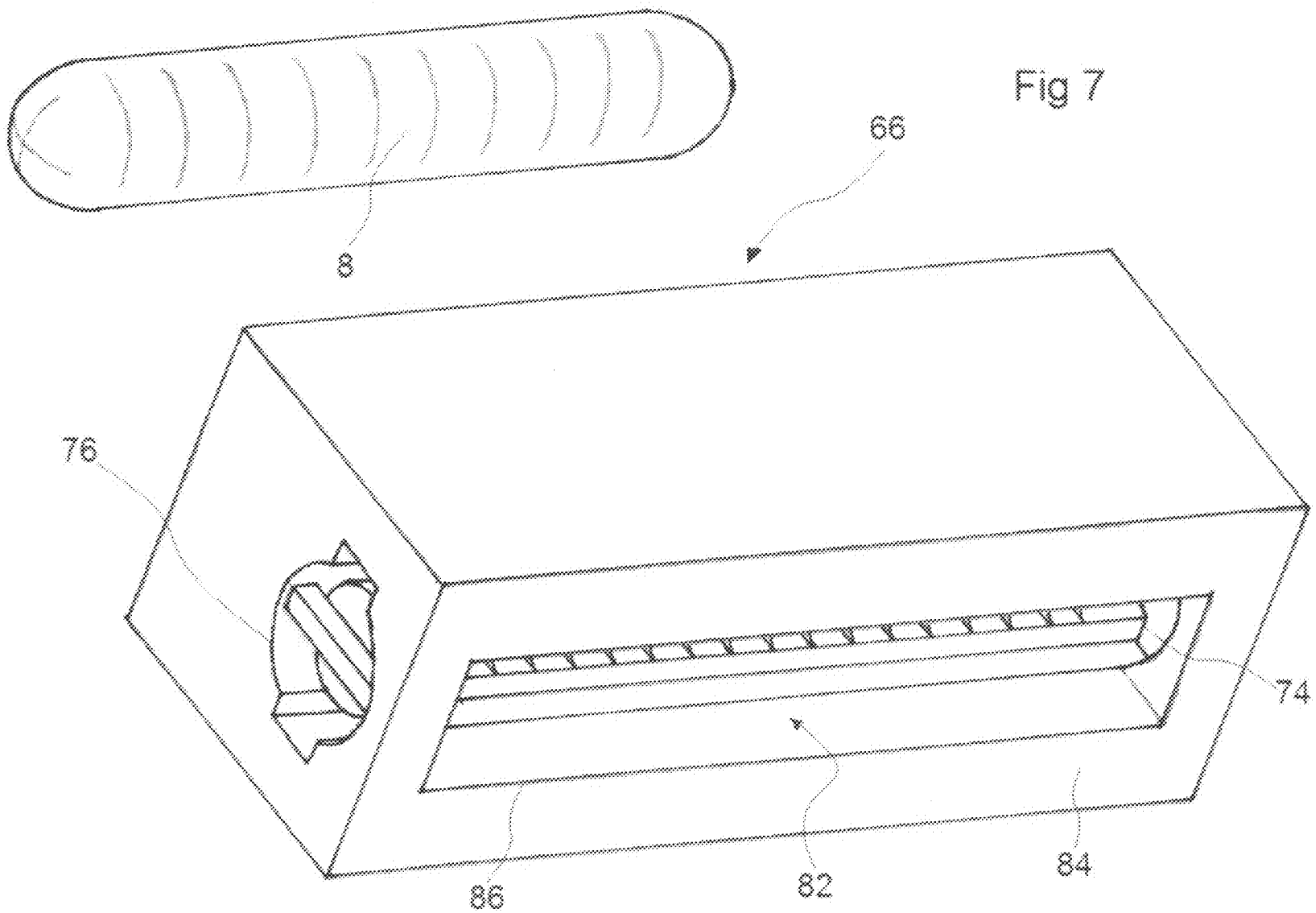
FIG. 7: Is a front, bottom, left side isometric view of a cutter housing showing a large sausage food product up above.

FIG. 7 A cutter housing 66 is provided with a handle bar inlet 74 at one end, and a handle bar outlet 76 at the opposite longitudinal end, having the middle portion forming a lower momentary food containment chamber 82, opened therethrough to the bottom surface 84 of the respective cutter housings 66 food ejector inlet 86.

Figure 8:
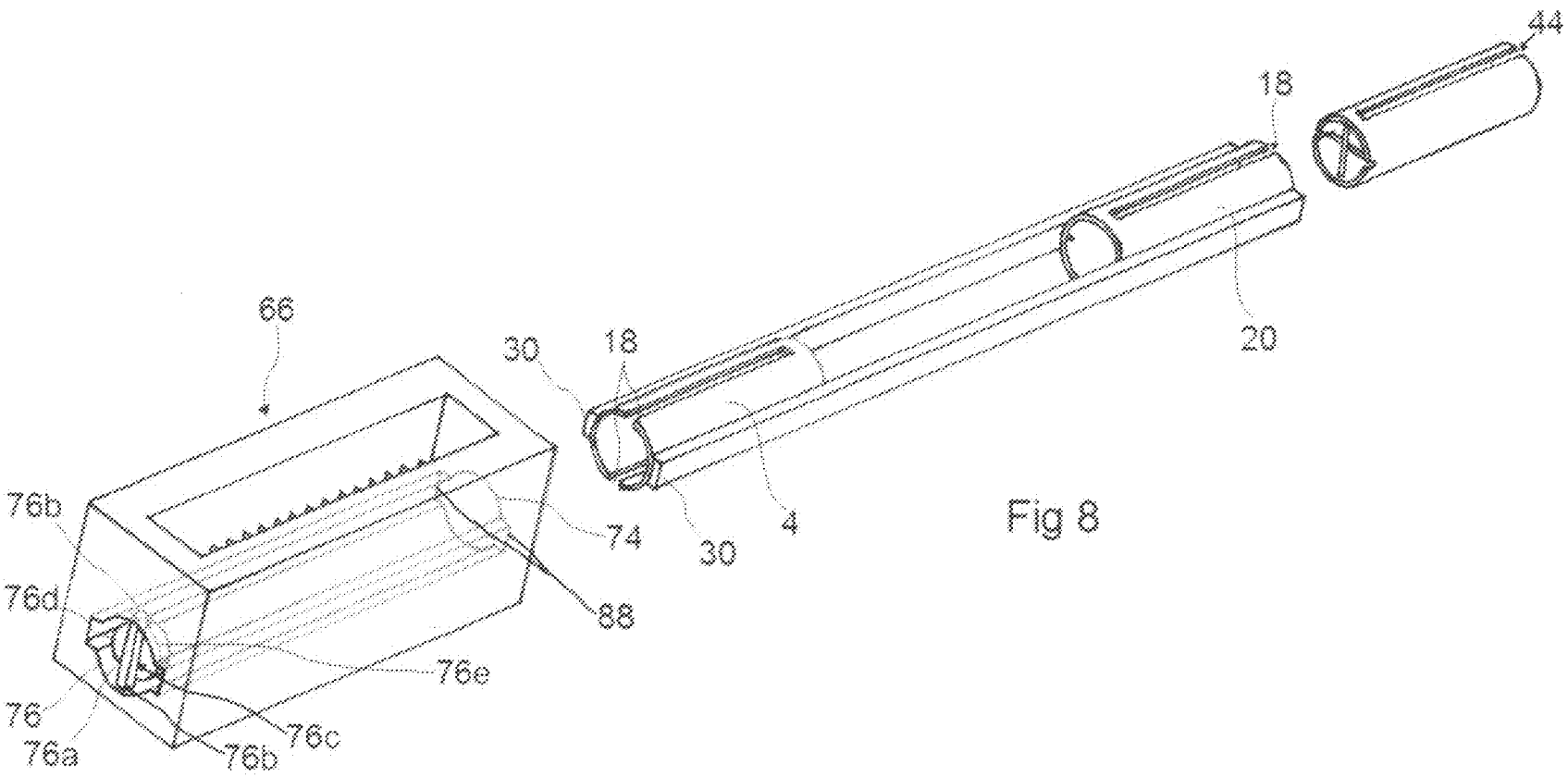
FIG. 8: Is a front, top, left side isometric view of a handle bar apparatus having a cutter housing at one end and a tubular sleeve containment cutting chamber at the opposite end. A food barrier is also shown mounted in the respective cutter housing.

FIG. 8 A handle bar inlet 74 and a handle bar outlet 76 having a larger inside circumference than a tubular containment cutting chamber 4 and a tubular containment chambers 20 out side circumference.

A handle bar inlet 74 and a handle bar outlet 76 are provided with openings on the inside circumference forming a guide beam slots 88 oriented longitudinally therethrough a cutter housing 66.

A guide beam slot 88 having a larger inside dimension to allow the passage of a guide beam 30 outside dimension.

A handle bar outlet 76 located on one end of a cutter housing 66 is provided with a center mounted vertically oriented pillar 76*a* having a top and bottom fixed mount 76*b* to the inside circumference of the respective handle bar outlet 76.

A pillar 76*a* having a smaller lateral thickness to allow the passage of a slots 18, 44 width opening (only four of six slots shown in FIG. 8).

A pillar 76*a* having a fixed mount 76*c* on a backside surface 76*d* of a food barrier 76*e*.

Figure 9:
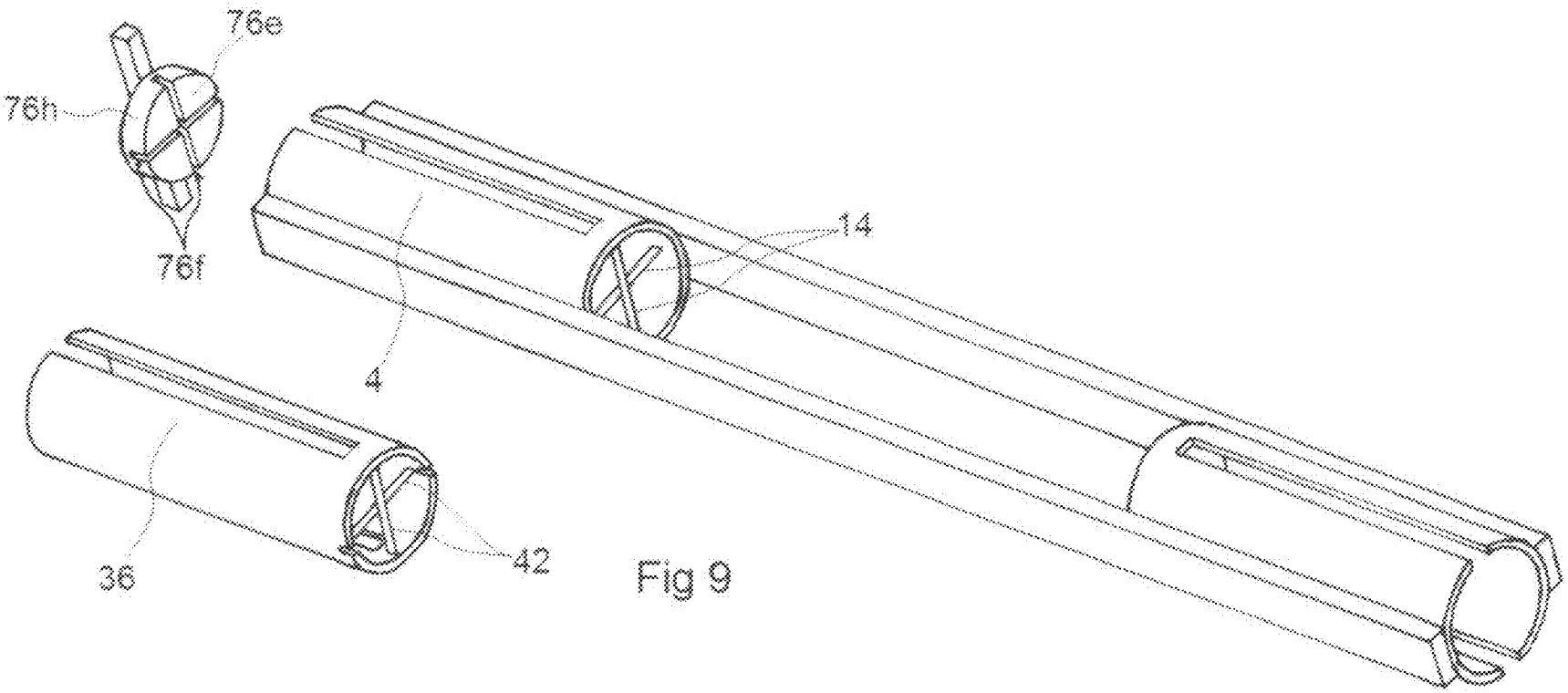
FIG. 9: Is a front, top, right side isometric view showing a tubular sleeve containment cutting chamber in front of a handle bar apparatus having a food barrier at one end unassembled from a cutter housing (the respective cutter housing not shown in this view).

FIG. 9 A clearance slot 76*f* having a larger opening and depth than the perpendicular blades that would be 14, 42 provided inside both, a tubular containment cutting chamber 4, and a tubular sleeve containment cutting chamber 36.

FIG. 10 A cutter housing 66 is provided with a food ejector inlet 86 on it's bottom surface 84 configured longer, and wider to allow passage of a food ejector 48.

FIG. 7 A cutter housing 66 is provided with a lower momentary food containment chamber 82, having a food ejector inlet 86 with an opening to a bottom surface 84, extending upwards to a bottom circumference on a handle bar inlet 74, and a handle bar outlet 76.

FIG. 10 A spring plunger 90 having a transversely oriented fixed mount 90*a* on an inside surface 92 located above a food ejector inlet 86.

A spring plunger 90 extending into a lower momentary food containment chamber 82.

A cutter housing 66 is provided with a lever lock pocket 94 having an opening from a bottom surface 84 to form a lever slot 96, opening therethrough to an opening to the lower portion of a guide beam slot 88 (both 96 and 88 shown in hidden lines in FIG. 10).

Part number five: A lever lock.

In the drawings, reference numeral 98 istermed and indicates a lever lock in accordance with the invention.

A cutter housings 66 lever lock pocket 94, allows the passage of a lever lock 98.

Figure 11:
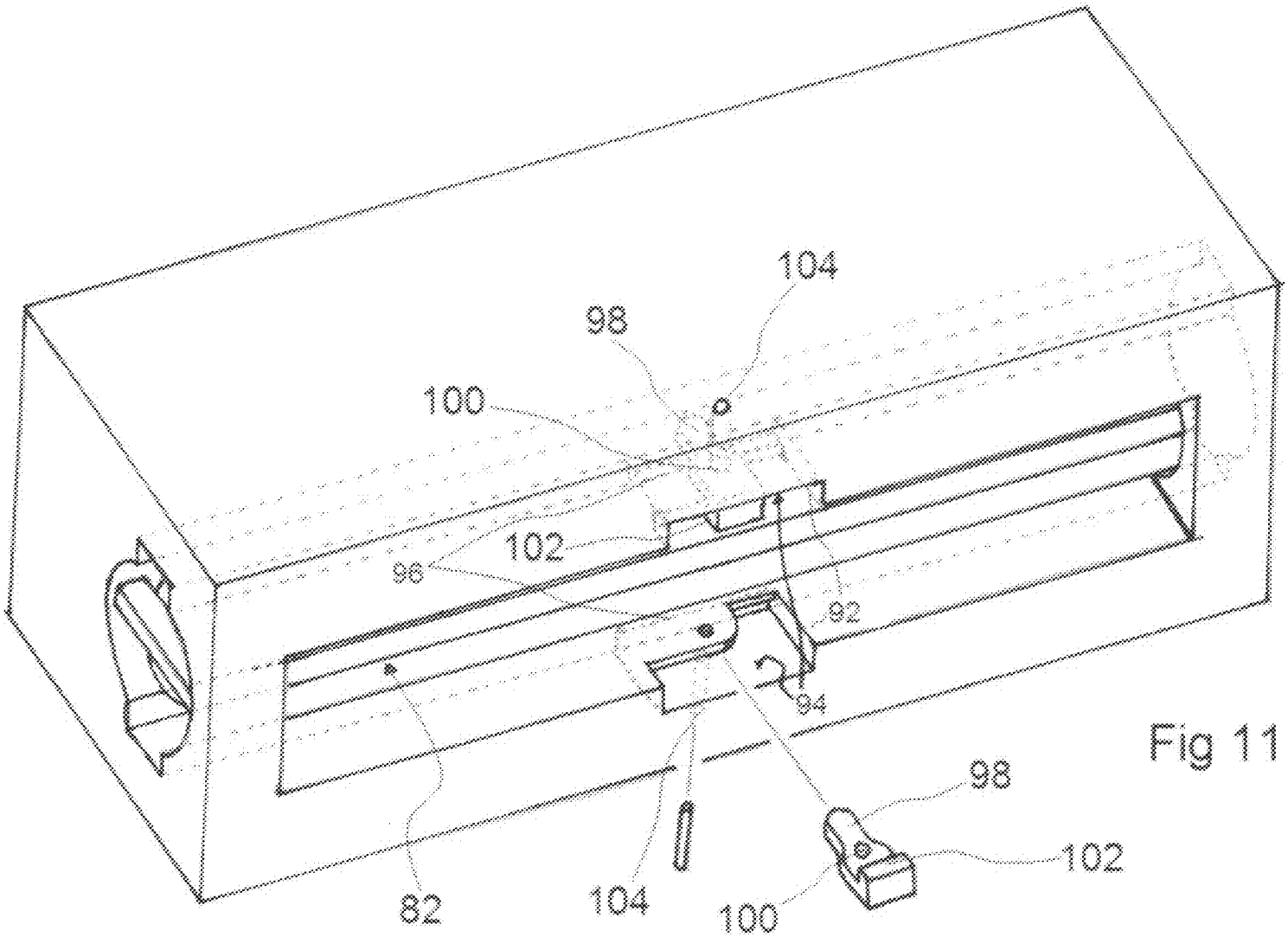
FIG. 11: Is a front, bottom, left side isometric view of a cutter housing showing one lower lever lock unassembled and an upper lever lock assembled, (all three sharing the same view).

FIG. 11 A lever lock 98 having a pivot hole 100 in the center, to be pivotally mounted to a cutter housings pivot hole 104.

A lever locks 98 lower ledge 102 protruding inwardly therethrough a lower momentary food containment chambers 82 inside surface 92.

FIG. 10 An upper side depression 106*a* located on a pusher fingers 106 side surface 56 extending downwardly from a top surface of the respective pusher finger, forming a lever lock resting position 106*b* (one lever lock resting positions 106*b* shown in hidden lines in FIG. 10).

A long side depression 106*c* located on said pusher fingers 108 side surface, extending downwardly from the respective pusher fingers top surface, and continuing all the way down to the top surface of a base 60 (only two of four long depressions shown in FIG. 10).

Figure 1:
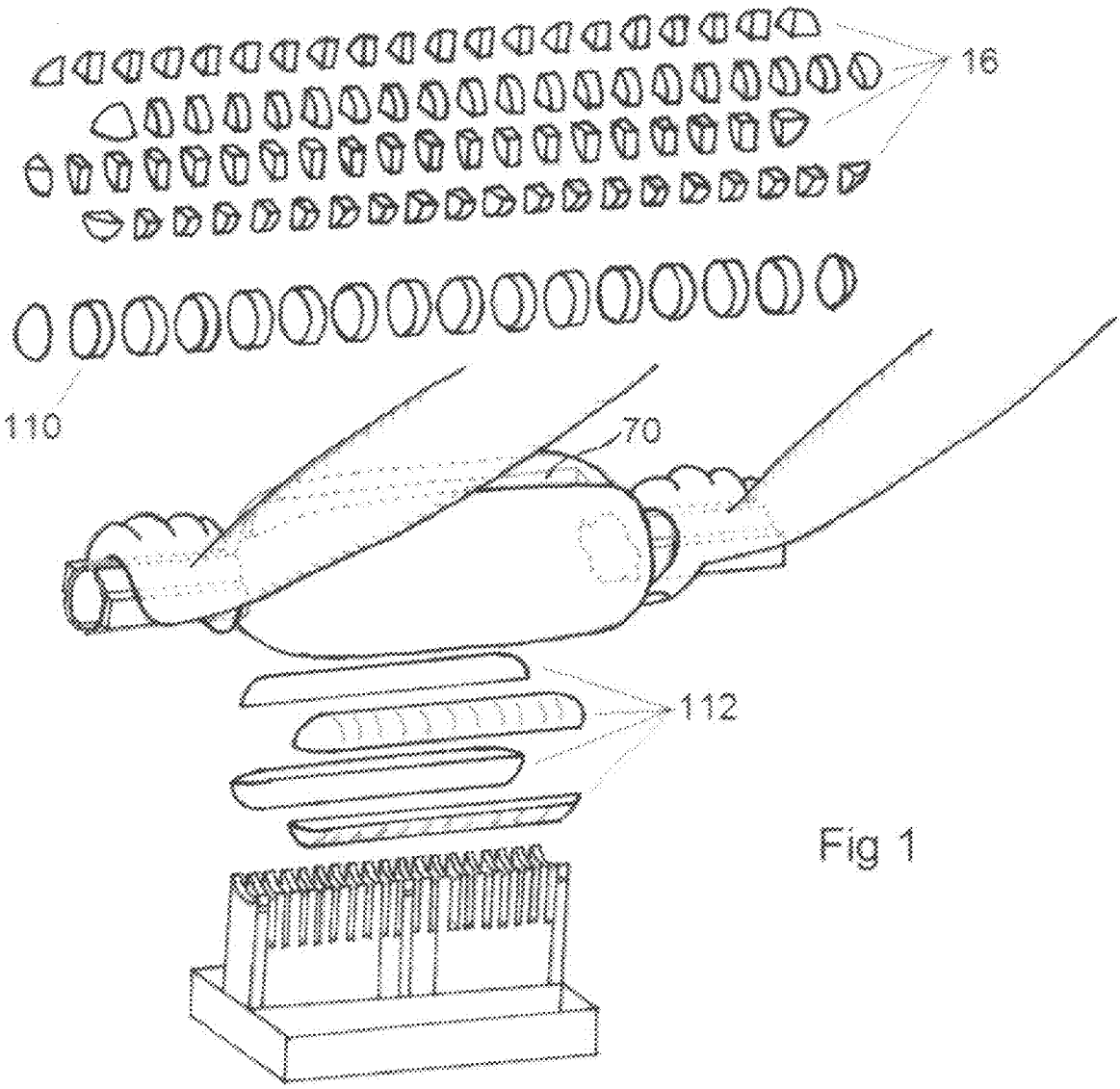
FIG. 1: Is a front, top, left side isometric view of a handle bar apparatus protruding out both sides of a cutter housing just above a food ejector. This view also shows the three different cuts made on a hot dog from this device.

FIG. 1 All the parts have been defined above. The rest of the detailed description of embodiment will now focus on how all the above mentioned parts work together in a structured way to cut an array of slice through food pieces 110, and long cut wedge pieces 112 from one end of a food product to the opposite longitudinal end.

And finally, this will define how the two above cut operations and parts work together in a three dimensional way to create cut cubed or diced food pieces 16.

Creating slices 110 from a food product described next.

Figure 12:
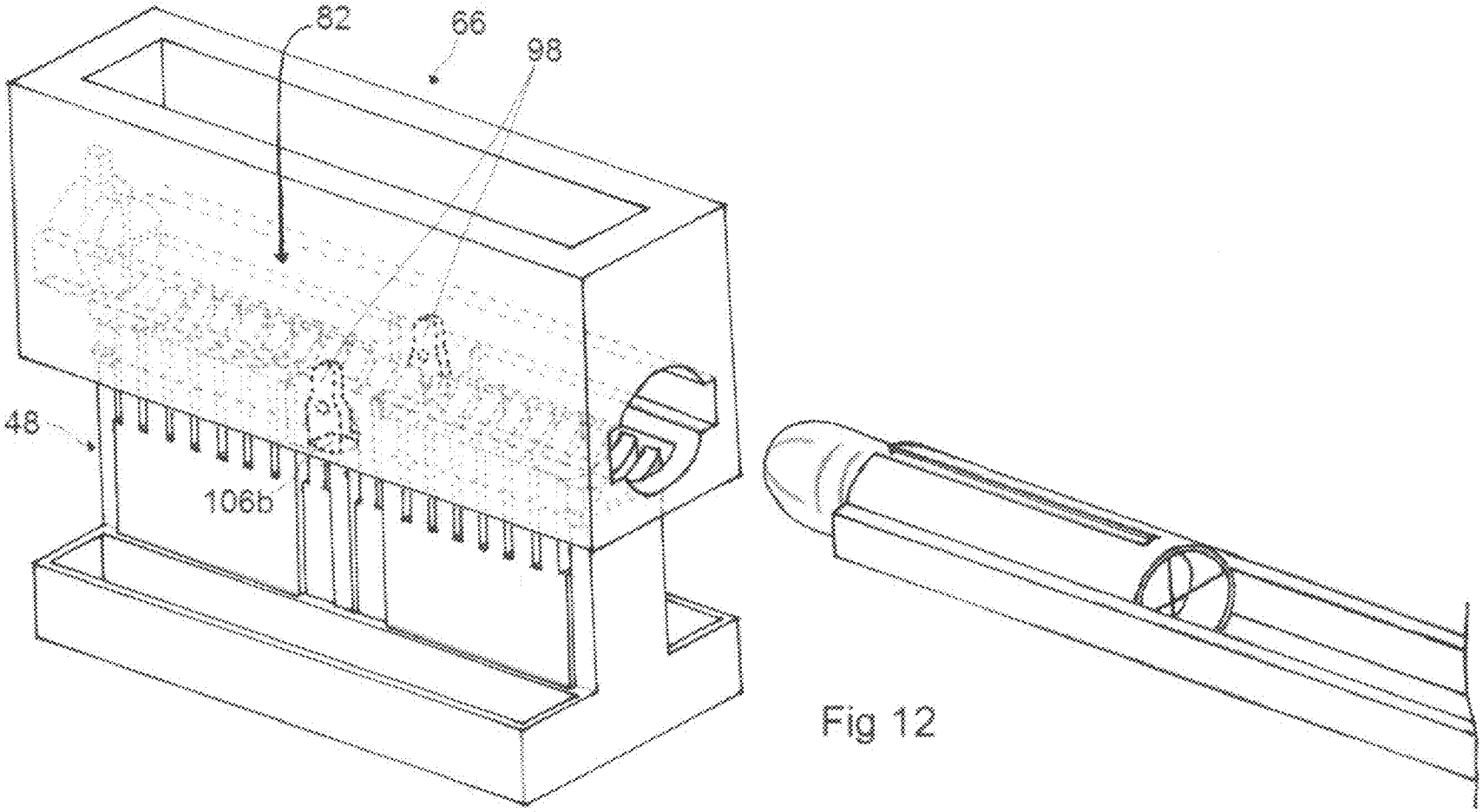
FIG. 12: Is a front, top, right side isometric view of a cutter housing mounted over top of a food ejector forming a momentary food containment chamber together and showing the lever locks holding it up.

FIG. 12 A cutter housing 66 with it's lever lock 98 vertically oriented, is positioned by hand on top of a food ejectors 48 lever lock resting position 106*b* (only one of two lever lock resting positions shown in FIG. 12) having the respective food ejector 48 and the respective cutter housing 66 form a lower momentary food containment chamber 82.

FIG. 13 A food product 8 is inserted by hand into a tubular containment chambers 20 food product inlet 22 located at one end of a handle bar apparatus 2.

FIG. 14 In this example, a handle bar apparatus 2 has three purposeful applications, in that it is intended for holding and locating a food product 8, than rotating a lever lock 98 off a lever lock resting position 106*b* (only one of two lever lock resting positions shown in FIG. 14).

A tubular containment chambers 20 food product inlet 22 containing a food product 8 (shown in dark hidden lines in FIG. 14) is inserted by hand into a cutter housings 66 handle bar inlet 74.

A guide beam 30 on a tubular containment chamber 20 will intersect and rotate the upper portion of a lever lock 98 to a horizontal position, which would release a lower ledge 102 of the respective lever lock 98 off of a food ejectors 48 lever lock resting position 106*b*.

A cutter housing 66 is still resting on a food ejectors 48 spring plunger resting position 58*c* (only two of four spring plunger resting positions shown in FIG. 14), with it's spring plunger 90 (only two of four spring plungers shown in FIG. 14).

A food product 8 is stopped by a food barrier 76*e* as the tubular containment chambers 20 slot 18 (only one of two slots shown in FIG. 14) allow it to continue through a handle bar outlet 76 and come to a complete stop with the closed end of the respective slot 18 resting against a pillar 76*a*.

A food product outlet 26 on a tubular containment chamber 20 clears a lower momentary food containment chamber 82 formed by a cutter housing 66 resting on a food ejector 48, to create a resting place for a food product 8.

FIG. 17 At this point a person would manually push down on a handle bar apparatus 2 that now sticks out of a handle bar inlet 74 and a handle bar outlet 76 located on each end of a cutter housing 66.

FIG. 5 An array of pusher fingers 58, 106, 108, 109 located on a food ejector 48 FIG. 6 would force a food product 8 through an array of cutting blades 72 located in a cutter housing 66 to a new resting position in a upper momentary food containment chamber 70.

FIG. 1 A food product 8 is now in the form of an array of evenly sliced through pieces 110.

Creating long wedge cuts 112 from a food product described next.

FIG. 12 A cutter housing 66 with it's lever lock 98 vertically oriented, is positioned by hand on top of a food ejectors 48 lever lock resting position 106*b* (only one of two lever lock resting positions shown in FIG. 12) having the respective food ejector 48 and the respective cutter housing 66 form a lower momentary food containment chamber 82.

FIG. 15 A food product 8 is inserted by hand into a tubular containment cutting chambers 4 food product inlet 10 located at one end of a handle bar apparatus 2.

FIG. 16 In this example, a handle bar apparatus 2 has four purposeful applications, in that it is intended for holding, locating, and cutting a food product 8, than rotating a lever lock 98 off a lever lock resting position 106*b* (only one of two lever lock resting positions shown in FIG. 16).

A tubular containment cutting chambers 4 food product inlet 10 containing a food product 8 (shown in dark hidden lines in FIG. 16) is inserted by hand into a cutter housings 66 handle bar inlet 74.

A guide beam 30 on a tubular containment cutting chamber 4 will intersect and rotate the upper portion of a lever lock 98 to a horizontal position, which would release a lower ledge 102 of the respective lever lock 98 off of a food ejectors 48 lever lock resting position 106*b* (only one of two lever lock resting positions shown in FIG. 16).

A cutter housing 66 is still resting on a food ejectors 48 spring plunger resting position 58*c* (only one of two spring plunger resting positions shown in FIG. 16), with it's spring plunger 90 (only one of two spring plungers shown in FIG. 16).

A food product 8 is stopped by a food barrier 76*e* as the tubular containment cutting chambers 4 slots 18 (only one of two slots shown in FIG. 16) allow it to continue through a handle bar outlet 76 while slicing the respective food product 8 with it's set of perpendicular blades 14 and comes to a complete stop with the closed end of the respective slots 18 resting against a pillar 76*a*.

A food product outlet 12 on a tubular containment cutting chamber 4, clears a lower momentary food containment chamber 82 formed by a cutter housing 66 resting on a food ejector 48, to create a resting place for a food product 8.

FIG. 17 At this point a person would manually lift on a handle bar apparatus 2 that now sticks out a handle bar inlet 74 and a handle bar outlet 76 located on each end of a cutter housing 66.

Once a cutter housing is lifted off a food ejector 48, a food product 8 is now in the form of four, but not limited too, long wedge cuts 112 down it's longitudinal length all the way through, which would normally be resting on the top surface 50 of the respective food ejector 48.

FIG. 1 Creating cubed or diced cuts 16 from a food product 8 described next.

FIG. 12 A cutter housing 66 with it's lever lock 98 vertically oriented, is positioned by hand on top of a food ejectors 48 lever lock resting position 106*b* (only one of two lever lock resting positions shown in FIG. 12), having the respective food ejector 48 and the respective cutter housing 66 form a lower momentary food containment chamber 82.

FIG. 3 A tubular sleeve containment cutting chambers 36 food product outlet end 40 is telescopically inserted by hand into a tubular containment chambers 20 food product inlet 22 located at one end of a handle bar apparatus 2 until it's sleeve locator slot 46 comes to a rest and locates with a sleeve locator pin 24.

FIG. 19 A food product 6 (shown in dark hidden lines in FIG. 19) is inserted by hand into a tubular sleeve containment cutting chamber 36 now located at one end of a handle bar apparatus 2.

In this example, a handle bar apparatus 2 has four purposeful applications, in that it is intended for holding, locating, and cutting a food product 6, than rotating a lever lock 98 off a lever lock resting position 106*b* (only one of two lever lock resting positions shown in FIG. 19).

FIG. 4 A tubular sleeve containment cutting chambers 36 having a food outlet end 40, telescopically inserted by hand into a tubular containment chambers 20 food inlet end 22.

A food product 6 is inserted by hand into a tubular sleeve containment cutting chambers 36 food product inlet 38 now located at one end of a handle bar apparatus 2.

FIG. 19 A tubular containment chambers 20 food product inlet 22 now containing a tubular sleeve containment cutting chamber 36 (shown through a drawn cut out viewing hole on the respective tubular containment chamber 20).

A food product 6 is inserted by hand into a cutter housings 66 handle bar inlet 74.

A guide beam 30 on a tubular containment chamber 20 will intersect and rotate the upper portion of a lever lock 98 to a horizontal position, which would release a lower ledge 102 of the respective lever lock 98 off of a food ejectors 48 lever lock resting position 106*b*.

A cutter housing 66 is still resting on a food ejectors 48 spring plunger resting position 58*c* (only one of two spring plunger resting positions shown in FIG. 19), with it's spring plunger 90 (only one of two spring plungers shown in FIG. 19).

A food product 6 is stopped by a food barrier 76*e* as tubular containment chambers 20 slots 18 (only one of two slots shown in FIG. 19) and the tubular sleeve containment cutting chambers 36 slots 44 (only one of two slots shown in FIG. 19) allow it to continue through a handle bar outlet 76 while slicing the respective food product 6 with it's set of perpendicular blades 42 and comes to a complete stop with the closed end of the respective slots 18, 44 resting against a pillar 76*a*.

Both food product outlets 26, 40 on a tubular containment chamber 20 and tubular sleeve containment cutting chamber 36 clear a lower momentary food containment chamber 82 formed by a cutter housing 66 resting on a food ejector 48, to create a resting place for a food product.

A food product 6 is now in the form of four, but not limited too, FIG. 17 long wedge cuts 112 down it's longitudinal length all the way through, which would now rest on the top surface 50 of the respective food ejector 48 (for illustration purposes, the long wedge cuts are shown floating above the respective food ejector 48).

FIG. 19 At this point a person would manually push down on a handle bar apparatus 2 that now sticks out of a handle bar inlet 74 and a handle bar outlet 76 located on each end of a cutter housing 66.

FIG. 5 An array of pusher fingers 58, 106, 108, 109 located on a food ejector 48 FIG. 17 would force the long wedge cuts 112 through FIG. 6 an array of cutting blades 72 located in a cutter housing 66 to a new resting position in a upper momentary food containment chambers 70.

FIG. 1 A food product is now in the form of an array of evenly sliced and diced pieces 16, which would normally be resting in an upper momentary food containment chamber 70. (For illustration purposes, the respective sliced and diced pieces are shown floating above the respective cutter housing 66).

FIG. 10 A lever lock 98 could be fitted with a number of different spring returns for a resilient return to a vertical position.

A resilient spring return for a lever lock 98 to a vertical position would be obvious to one in the art and easily designed in numerous ways, so no illustration of a spring return is shown in the drawings.

FIG. 20 A cutter housing 66 and handle bar apparatus 2 could be fitted with blades, wires, or any other known cutting device for slicing through a food product.

Although particular embodiments of the present invention have been described in the foregoing detailed description, it will be understood that the invention is capable of numerous sizes, rearrangements, modifications, and substitutions of parts without departing from the scope of the invention as set forth in the claims below.

What is claimed is:

1. A slicing dicing manual cutting device, comprising:

a handle bar apparatus for slicing a food product includes at one end a tubular containment cutting chamber; and said tubular containment cutting chamber having a food product inlet at one end and a food product outlet at the opposite end, which is provided with a set of perpendicular blades for cutting; and said tubular containment cutting chamber having a slot having an opening from the food product inlet end and extending the respective opening to a distance short of the food product outlet end without an opening; and two said blades used for cutting a food product, and the said blades are spaced at a 90 degree angle from each other around the inside circumference of said first tubular containment cutting chamber at said food product outlet end;

an elongated stop slot extending from the outer surface to the inner surface of said first tubular containment cutting chamber having parallel longitudinal axes said handle bar apparatus for slicing a food product includes at the opposite longitudinal end a tubular containment chamber; and said tubular containment chamber is provided with a food product inlet at one end and a food product outlet at the other end, having two locator pins and a slot having an opening from the food product inlet end and extending the respective opening to a distance short of the food product outlet end without an opening; and a horizontal guide beam having a longitudinal axis parallel to each of the tubular containment cutting chamber and tubular containment chamber; and both the tubular containment cutting chamber and tubular containment chamber are fixedly mounted on their outer surfaces with said guide beam; and a middle portion of the guide beam spans an opening between the food product outlet end of each of the tubular containment cutting chamber and the tubular containment chamber respectively, the guide beam, the tubular containment cutting chamber, and the tubular containment chamber being combined to form the handle bar apparatus a food ejector having a plurality of pusher fingers extending upward; and said food ejector is provided with a top surface; and said food ejectors top surface is configured smaller in length and width to allow passage through a food ejector inlet and outlet of a cutter housing; and said food ejectors top surface is recessed, having sides higher than the center on the respective top surface, creating a centering means for a food product; and said food ejector having an array of transversely oriented clearance slots open from a top surface and also opened on both side surfaces extending downwardly to a predetermined clearance depth, forming the pusher fingers; and an upper side depression located on said pusher fingers side surface, forming a spring plunger resting position for a spring plunger; and a lower side depression located on a pusher fingers side surface, forming a lower clearance for a spring plunger; and a top surface of a base is fixedly mounted to the bottom of the food ejectors plunger fingers; and said base extends out laterally from the food ejectors pusher fingers, for enhanced stability in the form of a reservoir; and said cutter housing is provided with an upper momentary food containment chamber located on a top surface of the cutter housing; and said upper momentary food containment chamber is provided with an array of transversely oriented cutting blades spaced longitudinally; and the cutting blade's top surface starts from the bottom of the upper momentary food containment chamber, and extends downwardly to the top circumference on said handle bar inlet, and said handle bar outlet; and each of the cutting blade's ends require being fixedly mounted to an upper momentary food containment chambers inside surface; and said cutter housing is provided with said handle bar inlet at one end, and a said handle bar outlet at the opposite longitudinal end, having a middle portion forming said lower momentary food containment chamber, opened therethrough to said bottom surface of the respective cutter housings food ejector inlet; and a handle bar inlet and a handle bar outlet having a larger inside circumference than each tubular containment cutting chambers outside circumference; and the handle bar inlet and handle bar outlet are provided with openings on the inside circumference forming guide beam slots oriented longitudinally through the cutter housing; and each guide beam slot having a larger inside dimension than a guide beam outside dimension to allow the passage of a guide beam; and the handle bar outlet located on one end of a cutter housing is provided with a center mounted vertically oriented pillar having a top and bottom fixed mount to the inside circumference of the respective handle bar outlet; and a pillar having a smaller lateral thickness to allow the passage of a slots width opening; and the pillar having said fixed mount on said backside surface of a food barrier; and a clearance slot having a larger opening and depth than the perpendicular blades that are inside each of the tubular containment cutting chamber, and the tubular sleeve containment chamber; and the cutter housing is provided with a food ejector inlet on it's bottom surface configured to be longer, and wider to allow the passage of a food ejector; and the cutter housing is provided with a lower momentary food containment chamber, having a food ejector inlet with an opening to a bottom surface, extending upwards to a bottom circumference on a handle bar inlet, and a handle bar outlet; and said spring plunger having a transversely oriented fixed mount on said inside surface located above a food ejector inlet; and said spring plunger extending into a lower momentary food containment chamber from a food ejector inlets inside surface; and said cutter housing is provided with a lever lock pocket having an opening from a bottom surface to form said lever slot opening therethrough to an opening to the lower portion of a guide beam slot; and said cutter housing's lever lock pocket allows the passage of said lever lock; and said lever lock having a pivot hole in the center, to be pivotally mounted to said cutter housing's pivot hole; and said lever locks lower ledge protruding inwardly through a lower momentary food containment chambers inside surface; and said upper side depression located on said pusher fingers side surface extending downwardly from a top surface of the respective pusher finger forms said lever lock resting position; and a long side depression located on said pusher fingers side surface, extending downwardly from the respective pusher fingers top surface, and continuing all the way down to the top surface of a base.

2. A slicing dicing manual cutting device of claim 1, wherein the tubular containment chamber is provided with two said locator pins; and said locator pins are fixedly mounted on the inside circumference of said tubular containment chambers food product outlet end.

3. A slicing dicing manual cutting device of claim 1, wherein an internal tubular sleeve containment cutting chamber is in the form of a smaller version of said first tubular containment cutting chamber, and is configured to be telescopically joined into said tubular containment chamber; and the internal tubular sleeve containment cutting chamber having said food product inlet at one end and said food product outlet, which is provided with a set of perpendicular blades for cutting; and said first tubular containment cutting chamber includes a slot having an opening from the food product inlet end and extending the respective opening to a distance short of a food product outlet end without an opening; and the internal tubular sleeve containment cutting chamber having said locator slot with an opening at its food product outlet end; and said locator slot is used for locating and aligning the outside diameter of an internal tubular sleeve containment cutting chamber, with a locator pin inside of said tubular containment chamber.

* * * * *